US011037503B2

(12) United States Patent
Xiao et al.

(10) Patent No.: US 11,037,503 B2
(45) Date of Patent: Jun. 15, 2021

(54) GATE DRIVING APPARATUS FOR PIXEL ARRAY AND DRIVING METHOD THEREFOR

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Lijun Xiao, Beijing (CN); Yihjen Hsu, Beijing (CN); Shuai Hou, Beijing (CN); Xu Lu, Beijing (CN); Fei Shang, Beijing (CN)

(73) Assignees: CHONGQING BOE OPTOELECTRONICS TECHNOLOGY CO., LTD., Chongqing (CN); BOE TECHNOLOGY GROUP CO.. LTD., Beijing (CN)

( * ) Notice: Subject to any disclaimer, the term of this patent is extended or adjusted under 35 U.S.C. 154(b) by 0 days.

(21) Appl. No.: 16/822,475

(22) Filed: Mar. 18, 2020

(65) Prior Publication Data

US 2020/0219452 A1 Jul. 9, 2020

Related U.S. Application Data

(62) Division of application No. 15/525,210, filed as application No. PCT/CN2016/098885 on Sep. 13, 2016, now Pat. No. 10,629,129.

(30) Foreign Application Priority Data

Oct. 8, 2015 (CN) ..... 201510645169.7

(51) Int. Cl.
*G09G 3/3266* (2016.01)
*G09G 3/3258* (2016.01)
(Continued)

(52) U.S. Cl.
CPC ..... *G09G 3/3266* (2013.01); *G09G 3/3258* (2013.01); *G09G 3/3291* (2013.01);
(Continued)

(58) Field of Classification Search
CPC .. G09G 3/3266; G09G 3/3258; G09G 3/3291; G09G 3/3614; G09G 3/3677;
(Continued)

(56) References Cited

U.S. PATENT DOCUMENTS

2008/0062072 A1 3/2008 Yang et al.
2008/0150860 A1* 6/2008 Hong ..... G09G 3/3677 345/87
(Continued)

FOREIGN PATENT DOCUMENTS

CN 101116132 A 1/2008
CN 103325333 A 9/2013
(Continued)

OTHER PUBLICATIONS

International Search Report and Written Opinion dated Nov. 28, 2016; PCT/CN2016/098885.
(Continued)

*Primary Examiner* — David Tung

(57) ABSTRACT

Disclosed are a gate driving apparatus for a pixel array and a driving method therefor. The pixel array includes N gate lines. The gate driving apparatus includes: a plurality of gate drivers, wherein the N gate lines are divided into a plurality of groups, each group includes a plurality of gate lines, each gate driver corresponds to the plurality of groups on a one-to-one basis, and is used for generating a gate driving
(Continued)

signal for the plurality of gate lines in the group corresponding thereto; and a driver control module which is used for generating a plurality of driver control signals corresponding to the plurality of gate drivers on a one-to-one basis, and state switching between any two driver control signals has at least a difference of first time, wherein under control of the driver control signals, the gate drivers are switched from first state to second state in sequence.

10 Claims, 9 Drawing Sheets

(51) Int. Cl.
*G09G 3/3291* (2016.01)
*G09G 3/36* (2006.01)

(52) U.S. Cl.
CPC ..... *G09G 3/3614* (2013.01); *G09G 3/3677* (2013.01); *G09G 2310/0202* (2013.01); *G09G 2310/0205* (2013.01); *G09G 2310/0218* (2013.01); *G09G 2310/0286* (2013.01); *G09G 2310/0291* (2013.01); *G09G 2310/062* (2013.01); *G09G 2310/08* (2013.01); *G09G 2330/025* (2013.01); *G09G 2330/026* (2013.01); *G09G 2330/027* (2013.01); *G09G 2330/04* (2013.01)

(58) Field of Classification Search
CPC ... G09G 2310/0202; G09G 2310/0205; G09G 2310/0286; G09G 2310/0291; G09G 2310/062; G09G 2310/0218; G09G 2310/08; G09G 2330/04; G09G 2330/025; G09G 2330/026; G09G 2330/027
See application file for complete search history.

(56) References Cited

U.S. PATENT DOCUMENTS

| | | | | |
|---|---|---|---|---|
| 2008/0150932 | A1 | 6/2008 | Takahashi | |
| 2009/0289884 | A1 | 11/2009 | Yanagi et al. | |
| 2010/0141850 | A1 | 6/2010 | Itoh | |
| 2013/0088470 | A1 | 4/2013 | Chang et al. | |
| 2013/0107152 | A1 | 5/2013 | Okumura | |
| 2013/0147697 | A1* | 6/2013 | Sung | G02F 1/136204 345/87 |
| 2013/0235026 | A1* | 9/2013 | Yamamoto | G11C 19/184 345/214 |
| 2014/0085289 | A1 | 3/2014 | Liang et al. | |
| 2014/0285413 | A1 | 9/2014 | Miyatake et al. | |
| 2015/0348507 | A1 | 12/2015 | Zhang et al. | |
| 2016/0189653 | A1 | 6/2016 | Kim et al. | |

FOREIGN PATENT DOCUMENTS

| | | |
|---|---|---|
| CN | 203895097 U | 10/2014 |
| CN | 105118472 A | 12/2015 |
| CN | 205211381 U | 5/2016 |

OTHER PUBLICATIONS

The First Chinese Office Action dated Mar. 1, 2017; Appln. 201510645169.7.
The Second Chinese Office Actlon dated May 17, 2017; Appln. 201510645169.7.
USPTO NOA dated Dec. 18, 2019 U.S. Appl. No. 15/525,210
USPTO FOA dated Oct. 8, 2019 U.S. Appl. No. 15/525,210.
USPTO NFOA dated Apr. 1, 2019; U.S. Appl. No. 15/525,210.
USPTO RR dated Sep. 28, 2018 U.S. Appl. No. 15/525,210.

* cited by examiner

GATE DRIVING APPARATUS FOR PIXEL ARRAY AND DRIVING METHOD THEREFOR

TECHNICAL FIELD

The present disclosure relates to a gate drive device of a pixel array and a drive method thereof:

BACKGROUND

A liquid crystal display belongs to a display product of dynamic scanning type. When displaying one-frame picture, the liquid crystal display scans pixels one row by one row, and enables human eyes to feel a displayed one-frame picture by utilizing human eyes' visual residual effect, so as to realize displaying of the entire picture. Therefore, in the process of normal display of the liquid crystal display, at each time point, a gate line signal of only one gate line is a scanning signal (for example, high voltage) to scan its corresponding pixel row, while gate line signals of remaining gate lines are non-scanning signals (for example, low voltage).

However, when the liquid crystal display is started up, it needs to initialize a gate line signal of each gate line to a low voltage (VGL) so as to initialize all the pixel rows to a non-scanning state, which thus cause that the current of a power supply voltage terminal providing a low voltage becomes very large in a moment; on the other hand, when the liquid crystal is shut down, for the reasons of eliminating shut-down image sticking and protecting the liquid crystal display and so on, it requires to put a gate line signal of each gate line at a high voltage (VGH), such that all the pixel rows are in a scanned state so as to realize quick discharging of all the pixels. At this time, it would result in that the current of the power supply voltage terminal providing a high voltage becomes very large in a moment.

Since the liquid crystal display causes the output current of the power supply voltage terminal that provides the low voltage (VGL) or the high voltage (VGH) to become very large when being started up or shut down, it then results in that a load of a power supply chip that provides the low voltage (VGL) or the high voltage (VGH) becomes very large in a moment, and also makes that the input current received by a power supply input terminal of the power supply chip from an external power supply becomes large in a moment, which is easy to cause the power supply chip damaged, a connection wire between a power supply input terminal of a power supply chip on the liquid crystal display panel and an external power supply burned out, and a fuse wire on the liquid crystal display panel damaged.

Therefore, a gate drive device which is capable of reducing current impact when the liquid crystal display is started up or shut down is needed.

SUMMARY

In order to solve the above technical problem, there is provided a gate drive device, which reduces the current impact when a liquid crystal display is started up or shut down by dividing all gate lines of the liquid crystal display into a plurality of groups, staggering the initialization operation of each group of gate lines for a period of time when the liquid crystal display is started up, and staggering discharging operation of each group of gate lines for a period of time when the liquid crystal display is shut down.

According to one aspect of the present disclosure, there is provided a gate drive device of a pixel array, the pixel array comprising N gate lines, the gate drive device comprising: a plurality of gate drivers, in which the N gate lines are divided into a plurality of groups, each of which comprises a plurality of gate lines, the plurality of gate drivers and the plurality of groups are in one-to-one correspondence, and each gate driver is used for generating gate drive signals for a plurality of gate lines in the group corresponding to the gate driver, where N is an integer greater than or equal to 4; a driver control module, configured to generate multiple driver control signals, the multiple driver control signals and the plurality of gate drivers are in one-to-one correspondence, and state switches of any two driver control signals in the multiple driver control signals differs at least a first time, wherein the plurality of gate drivers switch from a first state to a second state sequentially under control of the multiple driver control signals, and each of the gate drivers generates gate drive signals with an identical phase for a plurality of gate lines in its corresponding group in the second state.

According to an embodiment of the present disclosure, the first state is a normal operation state, and the second state is a shut-down transient state. In the first state, at any moment, only one gate drive signal of the plurality of gate drive signals generated by one gate driver of the plurality of gate drivers for the plurality of gate lines in a group corresponding to the gate driver is in a valid drive level while remaining gate drive signals are in an invalid drive level, and gate drive signals generated by remaining gate drivers in the plurality of gate drivers are in an invalid drive level; when one gate driver of the gate drivers switches from the first state to the second state, the gate driver simultaneously generates gate drive signals being in a valid drive level for a plurality of gate lines in the group corresponding to the gate driver.

According to the embodiment of the present disclosure, the first state is a shut-down state, and each of the gate drivers does not output a gate drive signal in the first state; the second state is a start-up transient state, and when one gate driver of the gate drivers switches from the first state to the second state, the gate driver simultaneously generates gate drive signals being in an invalid drive level for a plurality of gate lines in the group corresponding to the gate driver.

According to an embodiment of the present disclosure, the driver control module comprises: a plurality of control signal generating modules, each of which comprises: a control voltage generating module configured to generate a control voltage; and an output module, whose first input terminal receivers the control voltage generated by the control voltage generating module, second input terminal receives a reference voltage, and output terminal is taken as an output terminal of the control signal generating module, and configured to generate one driver control signal based on the control voltage and the reference voltage, the driver control signal is a first level when the control voltage and the reference voltage satisfy a first relationship, while the driver control signal is a second level when the control voltage and the reference voltage do not satisfy the first relationship.

According to an embodiment of the present disclosure, the driver control module comprises; a first control signal generating module, and a plurality of delay units; the first control signal generating module is configured to a first driver control signal, and comprises: a control voltage generating module configured to generate a control voltage; and an output module, whose first input terminal receives the control voltage generated by the control voltage generating module, second input terminal receives a reference voltage, and output terminal is taken as an output terminal of the first control signal generating module, configured to generate the first driver control signal based on the control voltage and the reference voltage, wherein the first driver control signal is the first level when the control voltage and the reference voltage satisfy the first relationship, while the first driver control signal is the second level when the control voltage and the reference voltage do not satisfy the first relationship; the plurality of delay units are configured to generate driver control signals other than the first driver control signal in the multiple driver control signals.

According to another aspect of the present disclosure, there is provided a drive method of the gate drive device as described above, comprising: generating, by a driver control module, multiple driver control signals sequentially, the multiple driver control signals and a plurality of gate drivers are in one-to-one correspondence, and state switching of any two driver control signals of the multiple driver control signals having a difference of at least a first time; and switching, by the plurality of gate drivers, from a first state to a second state sequentially under control of the multiple driver control signals respectively, and generating, by each of the gate drivers, gate drive signals with an identical phase for the plurality of gate lines in the group corresponding to the gate driver under ac second state.

According to an embodiment of the present disclosure, reference voltages of respective control signal generating modules in the plurality of control signal generating modules are the same with each other, and an output module of each of the plurality of control signal generating modules is made to generate sequentially the multiple driver control signals corresponding one-to-one with the plurality of gate drivers by controlling control voltages of respective control signal generating modules in the plurality of control signal generating modules.

According to an embodiment of the present disclosure, the control voltages of respective control signal generating modules in the plurality of control signal generating modules are the same with each other, and the output module of respective control signal generating modules in the plurality of control signal generating modules are made to generate sequentially the multiple driver control signals corresponding one-to-one with the plurality of gate drivers by controlling the reference voltages of respective control signal generating modules in the plurality of control signal generating modules.

According to the embodiment of the present disclosure, the output modules of respective control signal generating modules in the plurality of control signal generating module are made to generate sequentially the plurality of controller control signals corresponding one-to-one with the plurality of gate drivers by controlling the reference voltages and the control voltages of respective control signal generating modules in the plurality of control signal generating modules.

According to an embodiments of the present disclosure, generating multiple driver control signals by the driver control module comprises: generating a first driver control signal; and delaying a j-th driver control signal at least a first time to obtain a (j+1)-th driver control signal, where $j=1, \ldots, n-1$, n is a number of gate drivers in the gate drive device.

According to another aspect of the present disclosure, there is provided a display panel, comprising a pixel array, a source drive device, and a gate drive device according to embodiments of the present disclosure.

On one hand, by adopting the gate drive device according to the embodiments of the present disclosure, and by utilizing multiple control signals having a time delay between each other to control a plurality of gate drivers, the turn-on time of respective gate drivers can be made staggered when it is started up, such that impact current generated when the respective gate drivers are turned on are staggered from each other and not overlapped when it is started up, which reduces total impact currents (total impact currents of the power supply voltage terminal that provides the low voltage) when it is started up. On the other hand, by adopting the gate drive device according to the embodiments of the present disclosure, the turn-off time of respective gate drivers can be made staggered when it is shut down, such that impact current generated when the respective gate drivers are turned off are staggered from each other and not overlapped when it is shut down, which reduces total impact currents (total impact currents of the power supply voltage terminal that provides the high voltage) when it is shut down.

Other characteristics and advantages of the present disclosure will be described in the subsequent specification, and would be obvious partly from the specification, or would be understood through implementation of the present disclosure. Purposes and other advantages of the present disclosure can be realized and obtained through structures specifically indicated in the specification, Claims and drawings.

BRIEF DESCRIPTION OF THE DRAWINGS

The above and other purposes, characteristics and advantages of the present disclosure will become more evident by describing in detail the embodiments of the present disclosure in combination with figures. Drawings are used to provide further understanding of the embodiments of the present disclosure, form a part of the specification, are used to explain the present disclosure together with the embodiments of the present disclosure, and do not form a limitation to the present disclosure. In the figures, same reference marks represent generally same means or steps.

DETAILED DESCRIPTION

Figure 1A:
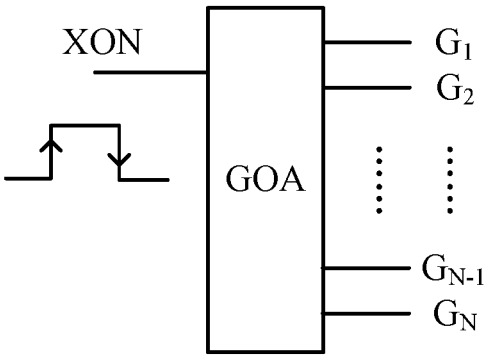
FIG. 1A shows a schematic diagram of a gate driver being controlled by a driver control signal when a present thin film transistor liquid crystal display is started up or shut down.

In order to make purposes, technical solutions and advantages of embodiments of the present disclosure more evident, exemplary embodiments of the present disclosure will be described in detail by referring to accompanying drawings. Obviously, the exemplary embodiments described below are just a part of embodiments of the present disclosure, but not all the embodiments of the present disclosure. All the other embodiments obtained by those skilled in the art without any inventive work shall fall into the protection scope of the present disclosure.

Herein, it should be noted that in the figures, the same reference numerals are basically given to components having the same or similar structures and functions, and their repeated description will be omitted.

As shown in FIG. 1A, when a present thin film transistor liquid crystal display (TFT-LCD) is started up or shut down, a gate driver GOA is controlled by a driver control signal XON. When the display is started up, the signal XON jumps from low level to high level, and all output terminals G1, G2, . . . , G(N−1), and GN of the gate driver are pulled down to a low voltage VGL, when the display is shut down, the signal XON jumps from high level to low level, and all the output terminals G1, G2, . . . , G(N−1), and GN of the gate driver are pulled up to a high voltage VGH. Generally, the high voltage VGH is a positive voltage, and the low voltage VGL is a negative voltage.

Figure 1B:
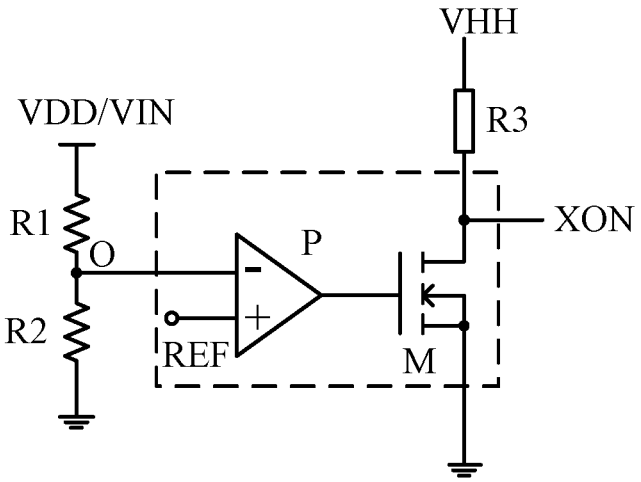
FIG. 1B shows a circuit diagram of a driver control signal generating module.

As shown in FIG. 1B, it shows a driver control signal XON generating module. The XON generating module comprises a comparator P and a switch transistor M. An inverting input terminal ("−") of the comparator P is connected to a connecting point O between voltage dividing resistors R1 and R2, a non-inverting input terminal ("+") thereof is connected to a reference voltage terminal REF, and an output terminal thereof is connected to a gate of the switch transistor M; a drain of the switch transistor M is connected to a high voltage terminal VIM via a pull-up resistor R3, and a source thereof is connected to a low voltage terminal VSS. For example, the high voltage terminal VHH can provide a high voltage of 3.3V, and the low voltage terminal VSS can be a ground and can provide a low voltage of 0V. For example, the reference voltage provided by the reference voltage terminal REF is higher than. 0V and lower than a dividing voltage generated at the connecting point O when a power supply voltage VDD/VIN is applied to the voltage dividing resistors R1 and R2.

When the liquid crystal display is started up, the power supply voltage VDD/VIN is applied to the voltage dividing resistors R1 and R2, and a voltage of the non-inverting input terminal of the comparator P in the XON generating module becomes lower than a voltage of the inverting input terminal thereof. Therefore, the output terminal of the comparator P outputs the low level, the switch transistor M in the XON generating module is switched off, and at this time the XON signal raises from low level to high level. On the other hand, when the liquid crystal display is shut down, since the power supply voltage VDD/VIN is not applied to the voltage dividing resistors R1 and R2, the voltage of the non-inverting input terminal of the comparator P in the XON generating module would become higher than the voltage of the inverting input terminal. Therefore, the output terminal of the comparator P outputs high level, the switch transistor M in the XON generating module is switched on, and the XON signal is pulled down from high level to low level.

Figure 2:
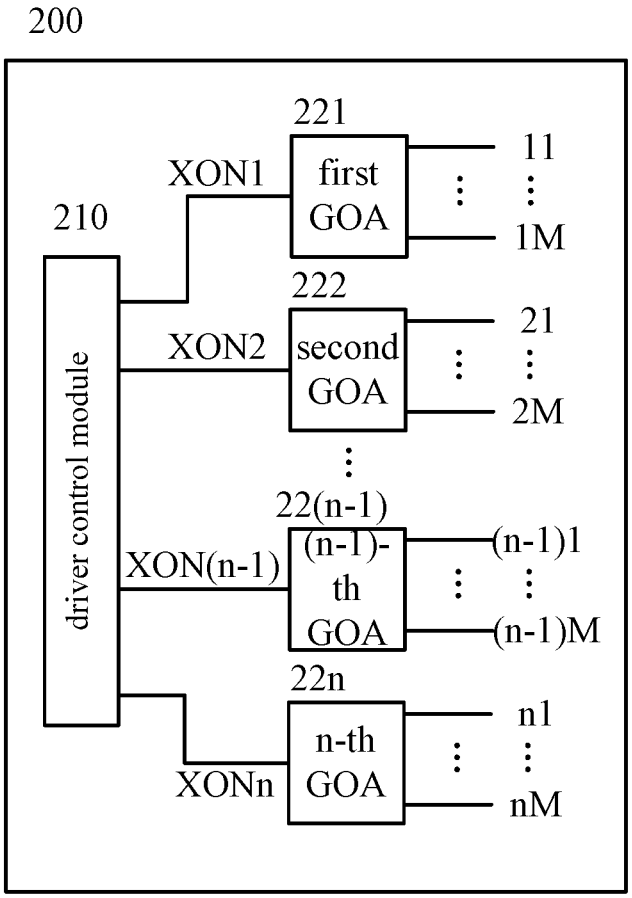
FIG. 2 shows a schematic block diagram of a gate drive device of an pixel array according to an embodiment of the present disclosure.

As shown in FIG. 2, it shows a schematic block diagram of a gate drive device 200 of a pixel array according to an embodiment of the present disclosure. According to the embodiment of the present disclosure, the gate drive device 200 comprises a plurality of gate drivers 221, 222, . . . , 22(*n*−1), 22*n* and a driver control module 210.

The pixel array comprises N gate lines which are divided into a plurality of groups, for example, n groups, each of which comprises a plurality of gate lines, where n is an integer greater than or equal to 2, and N is an integer greater than or equal to 4.

The plurality of gate drivers and the plurality of groups are in one-to-one correspondence, a first gate driver 221 corresponding to a first group of gate lines, a second gate driver 222 corresponding to a second group of gate lines, and so forth, a (n−1)-th gate driver 22(*n*−1) corresponding to a (n−1)-th group of gate lines, and a n-th gate driver 22*n* corresponding to a n-th group of gate lines. Each gate driver 22*i* is used to generate a gate drive signal for a plurality of gate lines in its corresponding i-th group, where i=1, . . . , n. Optionally, each group of gate lines can comprise gate lines with a same number. For example, each group of gate lines comprises M gate lines.

The driver control module 210 is configured to generate multiple driver control signals XON1, XON2, . . . , XON(n−1), XONn, and the multiple driver control signals XON1, XON2, . . . , XON(n−1), XONn and, the plurality of gate drivers 221, 222, . . . , 22(*n*−1), 22*n* are in one-to-one correspondence. State switching of any two driver control signals of the multiple driver control signals XON1, XON2, . . . , XON(n−1), XONn differs at least a first time. The state switching of the driver control signal can comprise at least one of: the driver control signal switches from the high level to the low level, the driver control signal switches from the low level to the high level, and the first time can be for example duration of current impact generated for each gate driver.

Under control of the multiple driver control signals XON1, XON2, . . . , XON(n−1), and XONn, the plurality of gate drivers 221, 222, . . . , 22(*n*−1), 22*n* switch from the first state to the second state sequentially, and each gate driver 22*i* generates a gate drive signal with the same phase for a plurality of gate lines in an i-th group corresponding to the gate driver 22*i* under the second state.

According to the embodiment of the present disclosure, in the process of start-up of the display, the first state is a shut-down state, and the second state is a start-up transient state. Under the first state, each gate driver does not output a gate driving signal. Under control of a driver control signal XONi corresponding to the i-th gate driver 22*i* in the plurality of gate drivers, when being switched from the first state (shut-down state) to the second state (start-up transient state), the i-th gate driver 22*i* generates a gate drive signal of an invalid drive level for the plurality of gate lines in its corresponding i-th group.

According to the embodiment of the present disclosure, in the process of shut-down of the display, the first state is a normal operation state, and the second state is a shut-down transient state. In the first state, at any moment, only one gate drive signal of the plurality of gate drive signals generated by one gate driver of the plurality of gate drivers for the plurality of gate lines in a group corresponding to the gate driver is in a valid drive level, while the remaining gate drive signals are in the inactive drive level, and gate drive signals generated by the remaining gate drivers in the plurality of gate drivers are all in the inactive drive level. Under control the driver control signal XONi corresponding to the i-th gate driver 22*i* in the gate drivers, when being switched from the first state (normal operation state) to the second state (shut-down transient state), the i-th gate driver 22*i* generates a gate drive signal of the active drive level for the plurality of gate lines in the i-th group corresponding to the gate driver 22*i*.

First Embodiment

Figure 3:
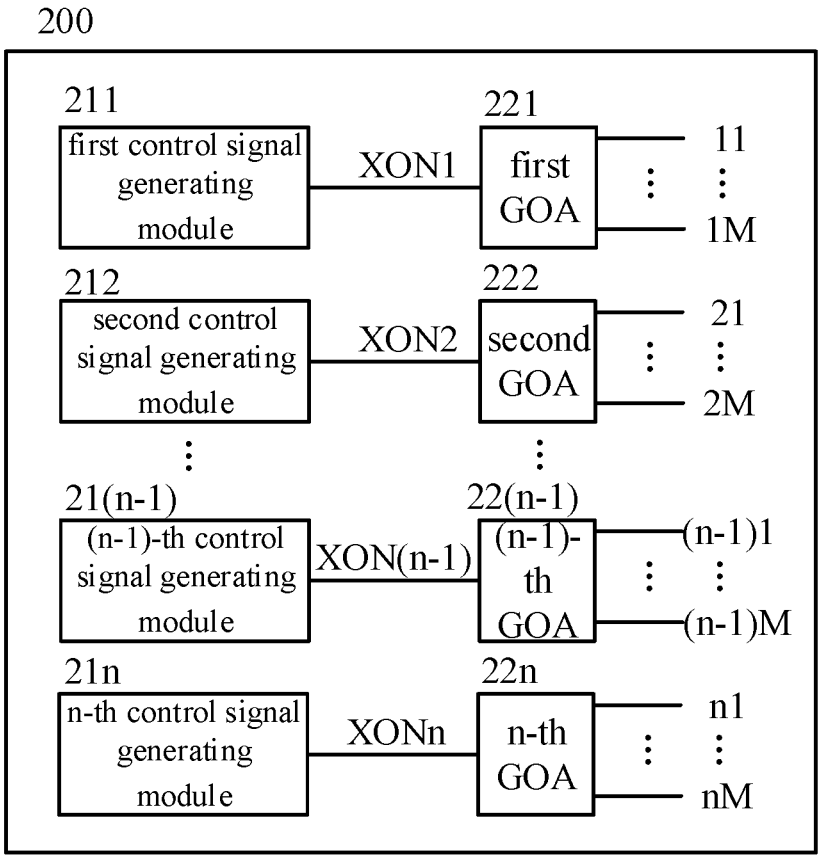
FIG. 3 shows a schematic block diagram of a driver control module according to a first embodiment of the present disclosure.

FIG. 3 shows a schematic block diagram of a driver control module according to a first embodiment of the present disclosure.

As shown in FIG. 3, the driver control module 210 comprises a plurality of control signal generating modules 211, 212, . . . , 21(*n*−1), 21*n*. The plurality of control signal generating modules 211, 212, . . . , 21(*n*−1), 21*n* and the plurality of gate drivers 221, 222, . . . , 22(*n*−1), 22*n* are in one-to-one correspondence. Each control signal generating module 21*i* generates a driver control signal XONi for the i-th gate driver 22*i* corresponding to the control signal generating module 21*i*. For example, a first control signal generating module 211 is corresponding to the first gate driver 221, and generates the driver control signal XON1 for the first gate driver 221; a second control signal generating module 212 is corresponding to the second gate driver 222, and generates the driver control signal XON2 for the second gate driver 222; and so on and so forth; a (n−1)-th control signal generating module 21(*n*−1) is corresponding to the (n−1)-th gate driver 22(*n*−1), and generates the driver control signal XON(n−1) for the (n−1)-th gate driver 22(*n*−1); a n-th control signal generating module 21*n* is corresponding to the n-th gate driver 22*n*, and generates the driver control signal XONn for the n-th gate driver 22*n*.

Figure 4:
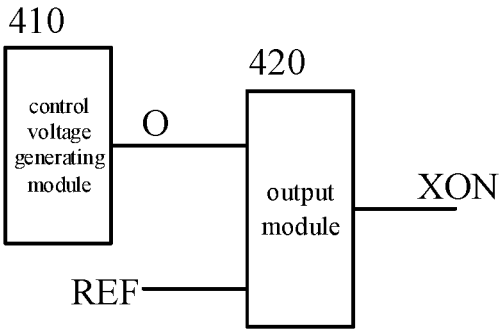
FIG. 4 shows a schematic block diagram of a control signal generating module according to a first embodiment of the present disclosure.

FIG. 4 shows a schematic block diagram of a control signal generating module according to an embodiment of the present disclosure.

Each control signal generating module can comprise a control voltage generating module 410 and an output module 420.

The control voltage generating module 410 is configured to generate a control voltage applicable to the control signal generating module.

A first input terminal of the output module 420 receives the control voltage generated by the control voltage generating module 410, a second input terminal thereof is connected to a reference voltage terminal REF and receives a reference voltage Vref from the reference voltage terminal REF, and an output terminal thereof is taken as an output terminal of the control signal generating module.

The output module 420 is configured to generate a driver control signal based on the control voltage $V_O$ generated by the control voltage generating module 410 and the reference voltage Vref received from the reference voltage terminal REF. In particular, when the control voltage $V_O$ and the reference voltage Vref satisfy a first relationship, the driver control signal is a first level; and when the control voltage $V_O$ and the reference voltage Vref do not satisfy the first relationship, the driver control signal is a second level. For example, when the control voltage $V_O$ is higher than the reference voltage Vref, the driver control signal XON is a high level; and when the control voltage $V_O$ is not higher than the reference voltage Vref, the driver control signal XON is low level.

Figure 5A:
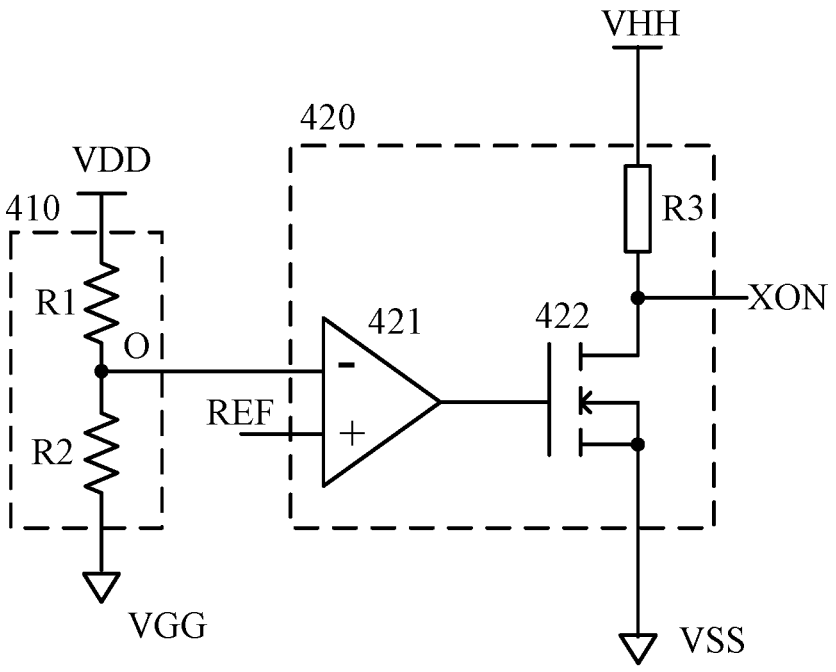
FIG. 5A shows a first schematic circuit diagram of a control signal generating module according to a first embodiment of the present d disclosure.

FIG. 5A shows a first schematic circuit diagram of a control signal generating module according to an embodiment of the present disclosure.

The control voltage generating module 410 comprises a first resistor R1 and the second resistor R2. A first terminal of the first resistor R1 is connected to a first power supply voltage terminal VDD, a second terminal of the first resistor R1 is connected to a first terminal of the second resistor R2, a second terminal of the second resistor R2 is connected to a second power supply voltage terminal VGG and a connecting point O between the second terminal of the first resistor R1 and the first terminal of the second resistor R2 is taken as the output terminal of the control voltage generating module 410.

The output module 420 comprises a comparator 421, a switch transistor 422, and a third resistor R3. An inverting input terminal ("−") of the comparator 421 is taken as the first input terminal of the output module 420 and connected to the output terminal of the control voltage generating module 410, a non-inverting input terminal ("+") thereof is taken as the second input terminal of the output module 420 and connected to the reference voltage terminal, and an output terminal thereof is taken as the output terminal of the output module 420 and connected to a gate of the switch transistor 422. A first electrode of the switch transistor 422 is taken as the output terminal of the output module 420 and is connected to a third power supply voltage terminal VHH via the third resistor R3, and a second electrode thereof is connected to a fourth power supply voltage terminal VSS.

In the circuit diagram as shown in FIG. 5A, the first power supply voltage terminal VDD and the third power supply voltage terminal VHH can be a same power supply voltage terminal and can both provide a voltage of 3.3V; and the second power supply voltage terminal VGG and the fourth power supply voltage terminal VSS can be a same power supply voltage terminal and can be a ground. Additionally, in the circuit diagram as shown in FIG. 5A, the switch transistor 422 is a N channel enhancement switch transistor, a first electrode of the switch transistor 422 is a drain, and a second electrode thereof is a source.

In the process of start-up of the liquid crystal display, the first power supply voltage $V_{DD}$ of the first power supply voltage terminal VDD is applied to the first resistor R1 and the second resistor R2, and an output voltage at point O can be calculated according to a resistor voltage dividing formula:

$$V_O=(R_2/(R_1+R_2))*V_{DD} \quad (1)$$

where R1 is a resistance value of the first resistor R1, R2 is a resistance value of the second resistor R2, and VO is an output voltage at point O. When VO rises to be higher than the reference voltage Vref of the reference voltage terminal REF, an output of the comparator 421 switches from high level to low level, the switch transistor 422 changes from turn-on into turn-off, and the XON signal output by the output module 420 jumps from low level to high level.

On the other hand, in the process of shut-down of the liquid crystal display, the first power supply voltage $V_{DD}$ of the first power supply voltage terminal VDD is not applied to the first resistor R1 and the second resistor R2, and the output voltage VO at the point O is 0V. It is apparent that at this time the output voltage VO at the point O is lower than the reference voltage Vref of the reference voltage terminal REF, the output of the comparator 421 switches from low level to high level, the switch transistor 422 changes from turn-off into turn-on, and the XON signal output by the output module 420 jumps from high level to low level.

Figure 5B:
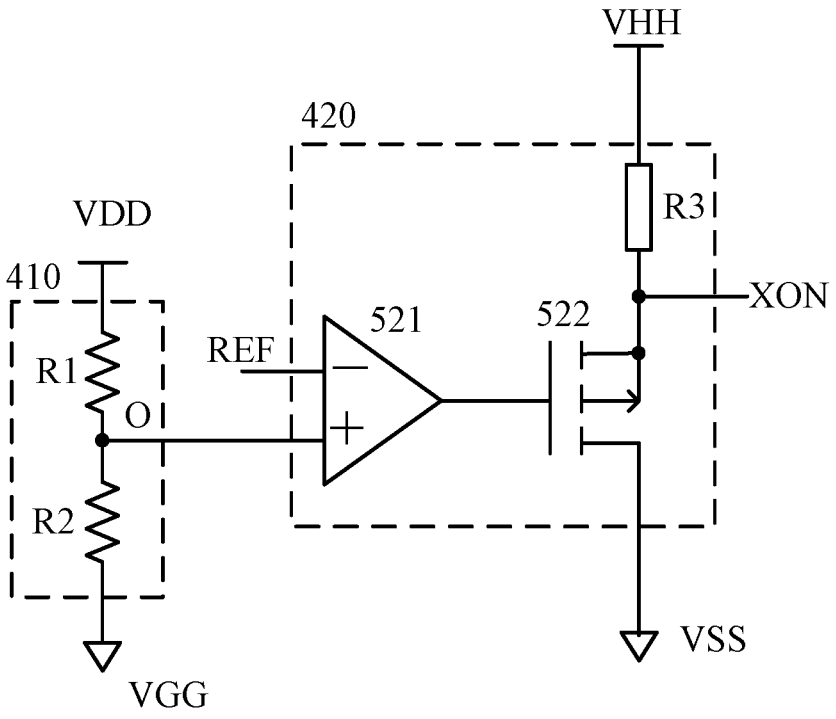
FIG. 5B shows a second schematic circuit diagram of a control signal generating module according to a first embodiment of the present disclosure.

FIG. 5B shows a second schematic circuit diagram of a control signal generating module according to an embodiment of the present disclosure.

The output module 420 comprises a comparator 521, a switch transistor 522 and a third resistor R3. An inverting input terminal ("−") of the comparator 521 is connected to the reference voltage terminal REF, a non-inverting input terminal ("+") thereof is connected to the output terminal of the control voltage generating module 410, and an output terminal thereof is connected to a gate of the switch transistor 522. A first electrode of the switch transistor 522 is connected to a third power supply voltage terminal via the third resistor R3, and a second electrode thereof is connected to a fourth power supply voltage terminal.

In the circuit diagram as shown in FIG. 5B, the first power supply voltage terminal VDD and the third power supply voltage terminal VHH can be a same power supply voltage terminal and can provide a voltage of 3.3V; and the second power supply voltage terminal VGG and the fourth power supply voltage terminal VSS can be a same power supply voltage terminal and can be a ground. Additionally, in the circuit diagram as shown in FIG. 5B, the switch transistor 522 is a P Channel enhancement switch transistor, a first electrode of the switch transistor 522 is a source, and a second electrode thereof is a drain.

In the process of start-up of the liquid crystal display, the first power supply voltage $V_{DD}$ of the first power supply voltage terminal. VDD is applied to the first resistor R1 and the second resistor R2. When the output voltage VO at point O rises to be higher than the reference voltage Vref of the reference voltage terminal REF, an output of the comparator 521 switches from low level to high level, the switch transistor 522 changes from turn-on into turn-off, and the XON signal output by the output module 420 jumps from low level to high level.

On the other hand, in the process of shut-down of the liquid crystal display, the first power supply voltage $V_{DD}$ of the first power supply voltage terminal VDD is not applied to the first resistor R1 and the second resistor R2, and the output voltage $V_O$ at the point O is 0V. Obviously, the reference voltage Vref of the reference voltage terminal REF is higher than the output voltage VO at the point O at this time, the output of the comparator 521 switches from high level to low level, the switch transistor 522 changes from turn-off into turn-on, and the XON signal output by the output module 420 jumps from high level to low level.

Figure 6:
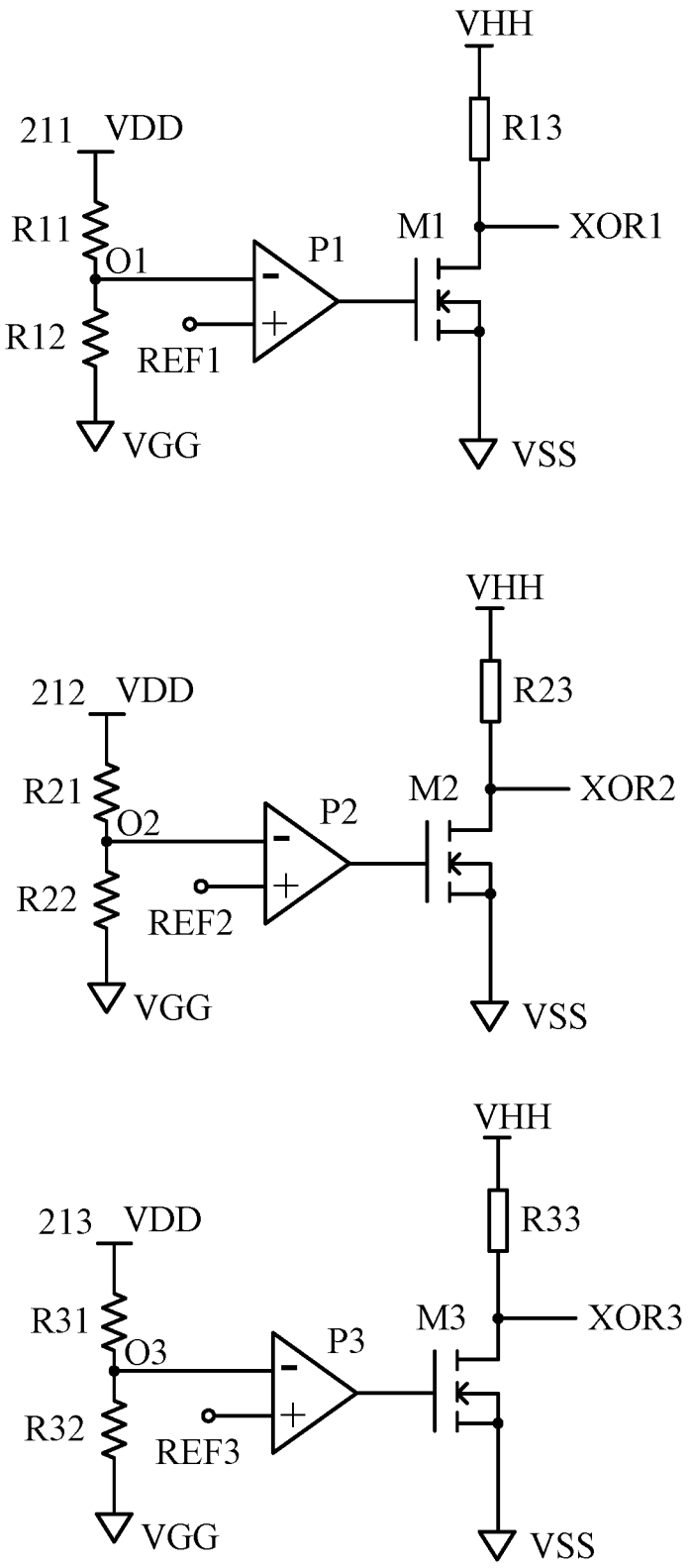
FIG. 6 shows a schematic circuit diagram of a driver control module according to a first embodiment of the present disclosure.

In FIG. 6, the schematic circuit diagram of driver control module 210 is shown by taking the control voltage generating module as shown in FIG. 5A as an example and taking the driver control module 210 comprising three control signal generating module as an example.

A control voltage generating module of the first control signal generating module 211 comprises a resistor R11 and a resistor R12, and an output module thereof comprises a first comparator P1, a first switch transistor M1 and a resistor R13.

A control voltage of the second control signal generating module 212 comprises a resistor R21 and a resistor R22, and an output module thereof comprises a second comparator P2, a second switch transistor M2 and a resistor R23.

A control voltage generating module of the third control signal generating module 213 comprises a resistor R31 and a resistor R32, and an output module thereof comprises third comparator P3, a third switch transistor M3 and a resistor R33.

In the process of start-up of the liquid crystal display, the first power supply voltage of the first power supply voltage terminal is applied to the resistors R11 and R12 of the first control signal generating module 211, to the resistors R21 and R22 of the second control signal generating module 212, and to the resistors R31 and R32 of the third control signal generating module 213. At this time, an output voltage of an output terminal O1 in the first control signal generating module 211, an output voltage of an output terminal O2 in the second control signal generating module 212, and an output voltage of an output terminal O3 in the third control signal generating module 213 can be represented as:

$$V_{O1}=(R_{12}/(R_{11}+R_{12}))*V_{DD}$$

$$V_{O2}=(R_{22}/(R_{21}+R_{22}))*V_{DD}$$

$$V_{O3}=(R_{32}/(R_{31}+R_{32}))*V_{DD}$$

When $V_{O1}$ rises to be higher than a first reference voltage Vref1 of a first reference voltage terminal REF1, the XOR1 signal output by the first control signal generating module jumps from low level to high level; when $V_{O2}$ rises to be higher than a second reference voltage Vref2 of a second reference voltage terminal REF2, the XOR2 signal output by the second control signal generating module 212 jumps from low level to high level; and when $V_{O3}$ rises to be higher than a third reference voltage Vref3 of a third reference voltage terminal REF3, the XOR3 signal output by the third control signal generating module 213 jumps from low level to high level.

On the other hand, in the process of shut-down of the liquid crystal display, the first power supply voltage $V_{DD}$ of the first power supply voltage terminal VDD is not applied to the resistors R11 and R12 of the first control signal generating module 211, to the resistors R1 and R22 of the second control signal generating module 212, and to the resistors R31 and R32 of the third control signal generating module 213. When $V_{O1}$ decreases to be lower than a first reference voltage Vref1 of the first reference voltage terminal REF1, the XOR1 signal output by the first control signal generating module 211 jumps from high level to low level; when $V_{O2}$ decreases to be lower than a second reference voltage Vref2 of a second reference voltage terminal REF2, the XOR2 signal output by the second control signal generating module 212 jumps from high level to low level; and when $V_{O3}$ decreases to be lower than a third reference voltage Vref3 of a third reference voltage terminal REF3, the XOR3 signal output by the third control signal generating module 213 jumps from high level to low level.

By appropriately setting a time of $V_{O1}$ rising to be higher than Vref1, a time of $V_{O2}$ rising to be higher than Vref2, and a time of $V_{O3}$ rising to be higher than Vref3 in the process of start-up, a time that the XOR1 signal generated by the first control signal generating module 211 jumps from low level to high level, a time that the XOR2 signal generated by the second control signal generating module 212 jumps from low level to high level, and a time that the XOR3 signal generated by the first control signal generating module 213 jumps from low level to high level can be controlled. In other words, a time that the first gate driver 221 corresponding to the first control signal generating module 211 outputs a gate drive signal of low level at all output terminals thereof, a time that the second gate driver 222 corresponding to the second control signal generating module 212 outputs a gate drive signal of low level at all output terminals thereof, and a time that the third gate driver 223 corresponding to the third control signal generating module 213 outputs a gate drive signal of low level at all output terminals thereof can be controlled.

For example, reference voltages of respective control signal generating modules in the plurality of control signal generating modules can be the same with each other, and control voltages of the respective control signal generating modules in the plurality of control signal generating modules can be different from each other. By adjusting amplitudes of the control voltages of the respective control signal generating module, state switching time of driver control signals generated by the respective control signal generating modules can be adjusted, so that start-up time and shut-down time of the respective gate drivers can be adjusted correspondingly.

For example, reference voltages of respective control signal generating modules in the plurality of control signal generating modules can be different from each other, and control voltages of the respective control signal generating modules in the plurality of control signal generating modules can be the same with each other. By adjusting amplitudes of the reference voltages of the respective control signal generating module, state switching time of driver control signals generated by the respective control signal generating modules can be adjusted, so that start-up time and shut-down time of the respective gate drivers can be adjusted correspondingly.

For another example, reference voltages of respective control signal generating modules in the plurality of control signal generating modules can be different from each other, and control voltages of the respective control signal generating modules in the plurality of control signal generating modules can also be different each other. By adjusting amplitudes of the control voltages and the reference voltages of the respective control signal generating module, state switching time of driver control signals generated by the respective control signal generating modules can be adjusted, so that start-up time and shut-down time of the respective gate drivers can be adjusted correspondingly.

Figure 7:
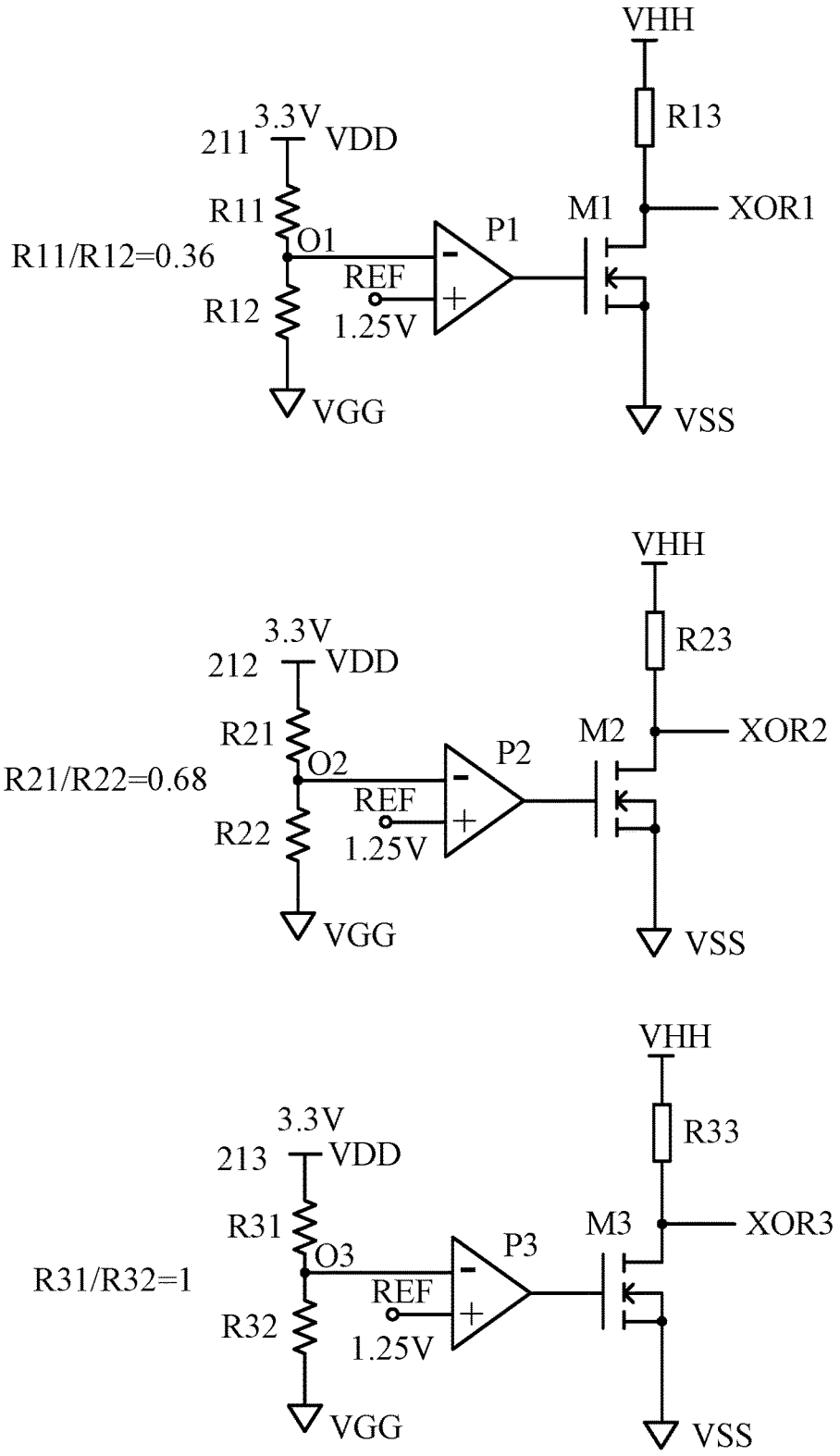
FIG. 7 shows one schematic specific implementation of a driver control module according to a first embodiment of the present disclosure.

FIG. 7 shows a schematic specific implementation of a driver control module 210 according to an embodiment of the present disclosure. In this specific implementation, reference voltages of respective control signal generating modules in the plurality of control signal generating modules are the same with each other, and control voltages of the respective control signal generating modules in the plurality of control signal generating modules are different from each other. By controlling control voltages of the respective control signal generating modules in the plurality of control signal generating modules, it makes that output modules of the respective control signal generating modules in the plurality of control signal generating modules generate the multiple driver control signals corresponding to the plurality of gate drivers one-to-one sequentially.

In FIG. 7, a resistance ratio of the resistor R11 and the resistor R12 in the first control signal generating module 211 is a first resistance ratio, a resistance ratio of the resistor R21 and the resistor R22 in the second control signal generating module 212 is a second resistance ratio, and a resistance ratio of the resistor R31 and the resistor R32 in the third control signal generating module 213 is a third resistance ratio, and the first resistance ratio is lower than the second resistance ratio, the second resistance ratio is lower than the third resistance ratio. In addition, the first reference voltage terminal of the first control signal generating module 211, the second reference voltage terminal o the second control signal generating module 212, and the third reference voltage terminal of the third control signal generating module 213 provide a same reference voltage and can be a same reference voltage terminal.

By appropriately setting the first resistance ratio, the second resistance ratio, and the third resistance ratio, the time that the output signal of the first comparator P1 switches from high level to low level, the time that the output signal of the second comparator P2 switches from high level to low level, and the time that the output signal of the third comparator P3 switches from high level to low level can be controlled. That is, the time that the XOR1 signal generated by the first control signal generating module 211 jumps from low level to high level, the tune that the XOR2 signal generated by the second control signal generating module 212 jumps from low level to high level, and the time that the XOR3 signal generated by the third control signal generating module 213 jumps from low level to high level can be controlled.

Figure 9:
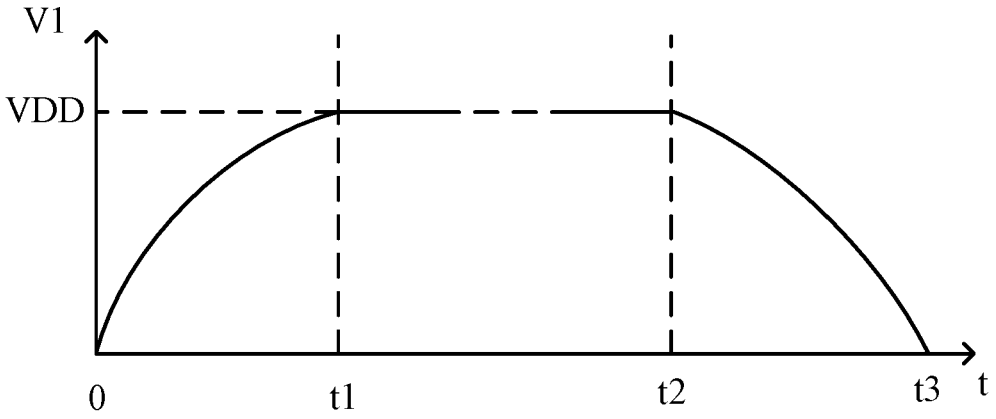
FIG. 9 shows a variation situation of a voltage of a first power supply voltage terminal in a process from start-up to shut-down of a liquid crystal display.

FIG. 9 shows a variation situation of the first power supply voltage $V_{DD}$ of the first power voltage terminal VDD in a process from start-up to shut-down of a liquid crystal display. In FIG. 9, in order to describe the embodiment of the present disclosure more clearly the variation period of time of the first power supply voltage $V_{DD}$ of the first power voltage terminal VDD is enlarged.

As shown in FIG. 9, in the process of start-up of the liquid crystal display, a voltage rising slope exists in the process of the first power supply voltage $V_{DD}$ rising from a zero voltage to a predetermined high voltage (for example, 3.3V), and the voltage rising time can be approximate to a level of millisecond, for example, hundreds of microseconds, several milliseconds, dozens of milliseconds, or even hundreds of milliseconds. Likewise, in the process of shut-down of the liquid crystal display, a voltage decreasing slope exists in the process of the first power supply voltage $V_{DD}$ decreasing from a predetermined high voltage to a zero voltage, and also the voltage decreasing time can be approximate to a level of millisecond, for example, hundreds of microseconds, several milliseconds, dozens of milliseconds, or even hundreds of milliseconds.

Returning to FIG. 7, the reference voltage is for example 1.25V, the first resistance ratio is for example 0.36, the second resistance ratio is for example 0.68, and the third resistance ratio is for example 1. Therefore, the output voltage of the output terminal O1 of the first control signal generating module 211, the output voltage of the output terminal O2 of the second control signal generating module 212, and the output voltage of the output terminal O3 of the third control signal generating module 213 can be represented as:

$$V_{O1}=(1/(0.36+1))*V_{DD}=(1/1.36)*V_{DD}$$

$$V_{O2}=(1/(0.68+1))*V_{DD}=(1/1.68)*V_{DD}$$

$$V_{O3}=(1/(1+1))*V_{DD}=(1/2)*V_{DD}$$

Therefore, for a same $V_{DD}$ rising curve, $V_{O1}$ reaches Vref at the earliest time, then $V_{O2}$ reaches Vref, and finally $V_{O3}$ reaches Vref A time that $V_{O2}$ reaches Vref lags a first lagging time than a time that $V_{O1}$ reaches Vref, a time that $V_{O3}$ reaches Vref lags a second lagging time than a time that $V_{O2}$ reaches Vref, and the first lagging time and the second lagging time can be several microseconds to several milliseconds. Correspondingly, the time that the XOR2 signal output by the second control signal generating module 212 jumps from low level to high level lags the first lagging time than the time that the XOR1 signal output by the first control signal generating module 211 jumps from low level to high level, and the time that the XOR3 signal output by the third control signal generating module 213 jumps from low level to high level lags the second lagging time than the time that the XOR2 signal output by the second control signal generating module 212 jumps from low level to high level.

Finally, the time that the second gate driver 222 outputs a gate drive signal of low level at all output terminals thereof lags the first lagging time than the time that the first gate driver 221 outputs the gate drive signal of low level at all output terminals thereof, and the time that the third gate driver 223 outputs a gate drive signal of low level at all output terminals thereof lags the second lagging time than the time that the second gate driver 222 outputs the gate drive signal of low level at all output terminals thereof.

Thus, in the process of start-up of the liquid crystal display, the start-up times of different gate drivers are staggered, that is, the times at which different gate drivers output gate drive signals of low level at all output terminals thereof are staggered, such that the times at which different gate drivers generate current impact are staggered. Which avoids the phenomenon that different gate drivers generate current impact at the same time and the current impacts generated by the respective gate drivers at the same time are overlapped to generate large current impact which results in damage of power supply chip, burn-out of power supply leads, and burn-out of fuse wires.

In the process of shut-down of the liquid crystal display, for a same $V_{DD}$ decreasing curve, $V_{O3}$ decreases from $V_{DD}$ to Vref at the earliest time, then $V_{O2}$ decreases from $V_{DD}$ to Vref, and finally $V_{O1}$ decreases from $V_{DD}$ to Vref. The time that $V_{O2}$ decreases from $V_{DD}$ to Vref lags a third lagging time than the time that $V_{O3}$ decreases from $V_{DD}$ to Vref, the time that $V_{O1}$ decreases from $V_{DD}$ to Vref lags a fourth lagging time than the time that $V_{O2}$ decreases from $V_{DD}$ to Vref, and the third lagging time and the fourth lagging time can be several microseconds to several milliseconds. Correspondingly, the time that the XOR2 signal output by the second control signal generating module 212 jumps from high level to low level lags the third lagging time than the time that the XOR3 signal output by the third control signal generating module 213 jumps from high level to low level, and the time that the XOR1 signal output by the first control signal generating module 211 jumps from high level to low level lags the fourth lagging time than the time that the XOR2 signal output by the second control signal generating module 212 jumps from high level to low level.

Finally, the time that the second gate driver 222 outputs a gate drive signal of high level at all output terminals thereof lags the third lagging time than the time that the third gate driver 223 outputs the gate drive signal of high level at all output terminals of the third gate driver 223, and the time that the first gate driver 221 outputs a gate drive signal of high level at all output terminals thereof lags the fourth lagging time than the time that the second gate driver 222 outputs the gate drive signal of high level at all output terminals thereof.

Thus, in the process of shut-down of the liquid crystal display, the shut-down times of different gate drivers are staggered, that is, the times at which different gate drivers output gate drive signals of high level at all output terminals thereof are staggered, such that the times at Which different gate drivers generate current impact at a high level output terminal are staggered, which avoids the phenomenon that different gate drivers generate current impact at the same time and the current impacts generated by the respective gate drivers at the same time are overlapped to generate large current impact which results in damage of power supply chip, burn-out of power supply leads, and burn-out of fuse wires.

Figure 8:
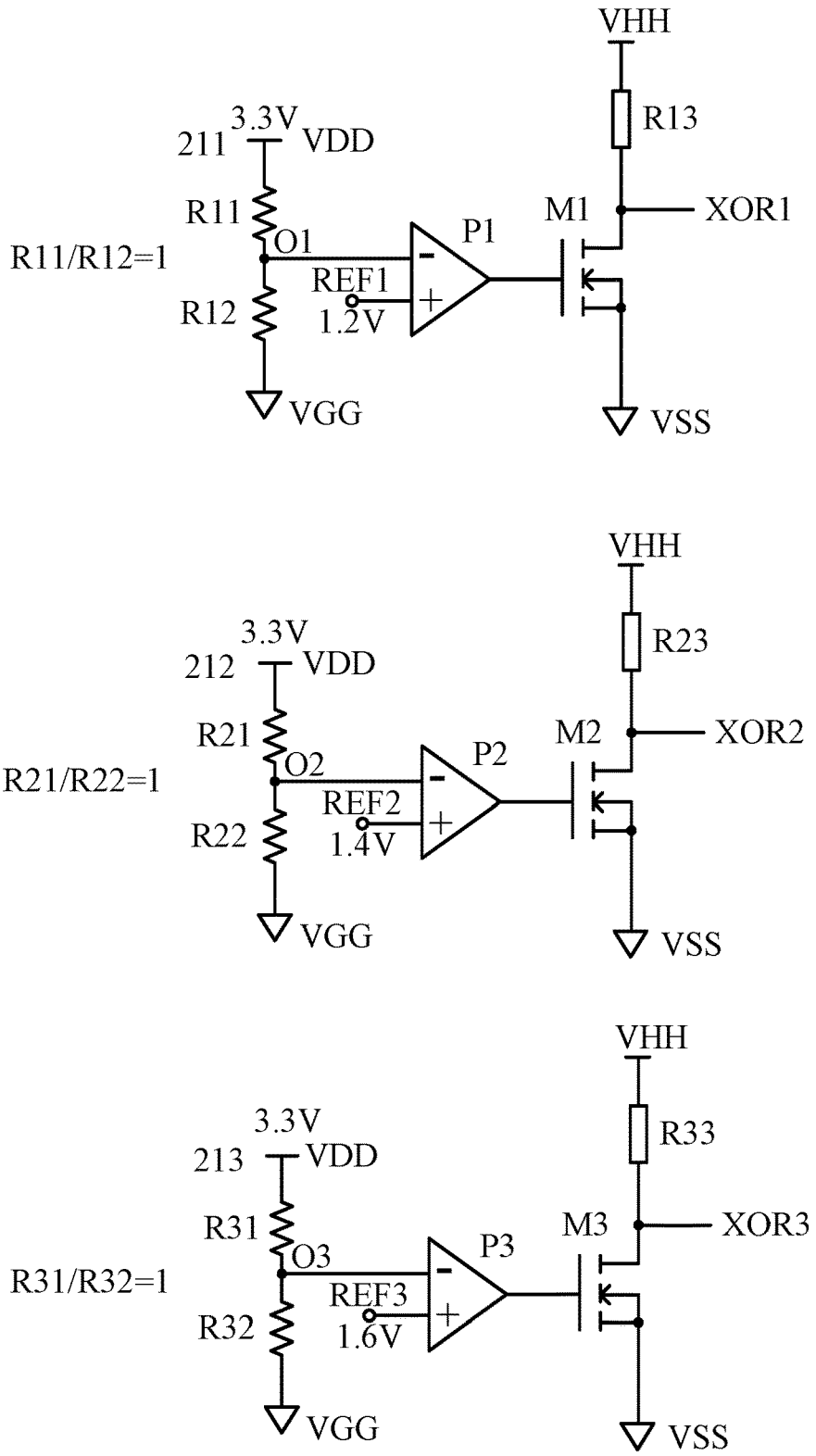
FIG. 8 shows another schematic specific implementation of a driver control module according to a first embodiment of the present disclosure.

FIG. 8 shows another schematic specific implementation of a driver control module 210 according to an embodiment of the present disclosure. In this specific implementation, reference voltages of respective control signal generating modules in the plurality of control signal generating modules are different from each other, and control voltages of the respective control signal generating modules in the plurality of control signal generating modules are the same with each other. By controlling the reference voltages of the respective control signal generating modules in the plurality of control signal generating modules, it makes that output modules of the respective control signal generating modules in the plurality of control signal generating modules generate sequentially the multiple driver control signals corresponding one-to-one with the plurality of gate drivers.

In FIG. 8, the first resistance ratio of the resistor R11 and the resistor R12 in the first control signal generating module 211, the second resistance ratio of the resistor R21 and the resistor R22 in the second control signal generating module 212, and the third resistance ratio of the resistor R31 and the resistor R32 in the third control signal generating module 213 are the same. In addition, the first reference voltage terminal in the first control signal generating module 211 provides a first reference voltage, the second reference voltage terminal in the second control signal generating module 212 provides a second reference voltage, and the third reference voltage in the third control signal generating module 213 provides a third reference voltage, and the first reference voltage is lower than the second reference voltage, the second reference voltage is lower than the third reference voltage.

For example, the first resistance ratio, the second resistance ration, and the third resistance ratio can be 1, and the first reference voltage, the second reference voltage and the third reference voltage can be 1.2V, 1.4V, and 1.6V sequentially.

In the process of start-up of the liquid crystal display, rising speeds of $V_{O1}$, $V_{O2}$, and $V_{O3}$ are the same. Therefore, $V_{O1}$ reaches Vref1 (1.2V) at the earliest time, then $V_{O2}$ reaches Vref2 (1.4V), and finally $V_{O3}$ reaches Vref3 (1.6V). The time that $V_{O2}$ reaches Vref2 lags a fifth lagging time than a time that $V_{O1}$ reaches Vref1, the time that $V_{O3}$ reaches Vref3 lags a sixth lagging time than a time that $V_{O2}$ reaches Vref2, and the fifth lagging time and the sixth lagging time can be several microseconds to several milliseconds. Correspondingly, the time that the XOR2 signal output by the second control signal generating module 212 jumps from low level to high level lags the fifth lagging time than the time that the XOR1 signal output by the first control signal generating module 211 jumps from low level to high level, and the time that the XOR3 signal output by the third control signal generating module 213 jumps from low level to high level lags the sixth lagging time than the time that the XOR2 signal output by the second control signal generating module 212 jumps from low level to high level.

Finally, the time that the second gate driver 222 outputs a gate drive signal of low level at all output terminals thereof lags the fifth lagging time than the time that the first gate driver 221 outputs the gate drive signal of low level at all output terminals thereof, and the time that the third gate driver 223 outputs a gate drive signal of low level at all output terminals thereof lags the sixth lagging time than the time that the second gate driver 222 outputs the gate drive signal of low level at all output terminals thereof.

Thus, in the process of start-up of the liquid crystal display, the start-up times of different gate drivers are staggered, that is, the times at which different gate drivers output gate drive signals of low level at all output terminals thereof are staggered, such that the times that different gate drivers generate current impact are staggered, which avoids the phenomenon that different gate drivers generate current impact at the same time and the current impacts generated by the respective gate drivers at the same time are overlapped to generate large current impact which results in damage of power supply chip, burn-out of power supply leads, and burn-out of fuse wires.

In the process of shut-down of the liquid crystal display, decreasing speeds of $V_{O1}$, $V_{O2}$, and $V_{O3}$ are the same. $V_{O3}$ decreases from $V_{DD}$ to Vref3 at the earliest time, then $V_{O2}$ decreases from $V_{DD}$ to Vref2, and finally $V_{O1}$ decreases from $V_{DD}$ to Vref1. The time that $V_{O2}$ decreases from $V_{DD}$ to Vref lags a seventh lagging time than the time that $V_{O3}$ decreases from $V_{DD}$ to Vref3, the time that $V_{O1}$ decreases from $V_{DD}$ to Vref1 lags an eighth lagging time than the time that $V_{O2}$ decreases from $V_{DD}$ to Vref2, and the seventh lagging time and the eighth lagging time can be several microseconds to several milliseconds. Correspondingly, the time that the XOR2 signal output by the second control signal generating module 212 jumps from high level to low level lags the seventh lagging time than the time that the XOR3 signal output by the third control signal generating module 213 jumps from high level to low level, and the time that the XOR1 signal output by the first control signal generating module 211 jumps from high level to low level lags the eighth lagging time than the time that the XOR2 signal output by the second control signal generating module 212 jumps from high level to low level.

Finally, the time that the second gate driver 222 outputs a gate drive signal of high level at all output terminals thereof lags the seventh lagging time than the time that the third gate driver 223 outputs the gate drive signal of high level at all output terminals thereof, and the time that the first gate driver 221 outputs a gate drive signal of high level at all output terminals thereof lags the eighth lagging time than the time that the second gate driver 222 outputs the gate drive signal of high level at all output terminals thereof.

Thus, in the process of shut-down of the liquid crystal display, the shut-down times of different gate drivers are staggered, that is, the time that different gate drivers output gate drive signals of high level at all output terminals thereof are staggered, such that the times that different gate drivers generate current impact at a high level output terminal are staggered, which avoids the phenomenon that different gate drivers generate current impact at the same time and the current impacts generated by the respective gate drivers at the same time are overlapped to generate large current impact which results in damage of power supply chip, burn-out of power supply leads, and burn-out of fuse wires.

Second Embodiment

Figure 10:
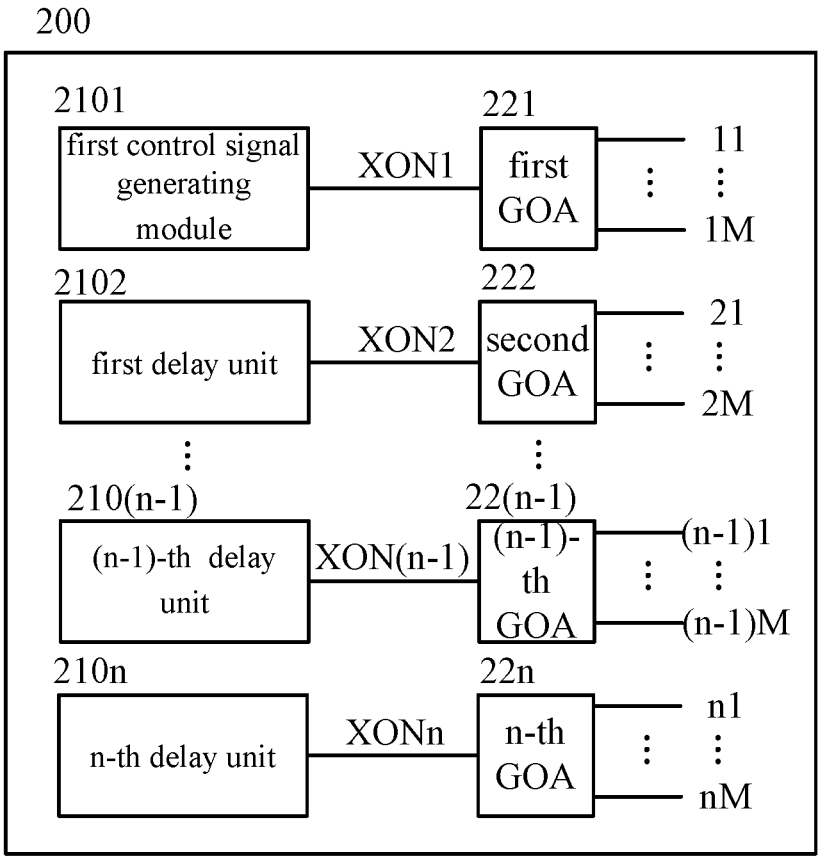
FIG. 10 shows a schematic block diagram of a driver control module according to a second embodiment of the present disclosure.

FIG. 10 shows a schematic block diagram of a driver control module according to a second embodiment of the present disclosure.

The driver control module 210 comprises a first control signal generating module 2101, and a plurality of delay units 2102, . . . , 210(*n*−1), 210*n*. The first control signal generating module 2101 is corresponding to a first gate driver 221, and generates a first driver control signal for the first gate driver 221. A first delay unit 2102 in the plurality of delay units is corresponding to a second gate driver 222, and generates a second driver control signal for the second gate driver 222, a second delay unit 2103 is corresponding to a third gate driver 223, and generates a third driver control signal for the third gate driver 223, and so on and so forth, a (n−2)-th delay unit 210(*n*−1) is corresponding to a (n−1)-th gate driver 22(*n*−1), and generates a (n−1)-th driver control signal for the (n−1)-th gate driver 22(*n*−1), and a (n−1)-th delay unit 210*n* is corresponding to a n-th gate driver 22*n*, and generates a n-th driver control signal for the n-th gate driver 22*n*.

The first control signal generating module 2101 is configured to generate a first driver control signal, which is used to control the first gate driver 221. The first control signal generating module 2101 can adopt the circuit structure as shown in FIG. 5A or FIG. 5B, and thus no further description is given herein.

The plurality of delay units are configured to generate driver control signals other than the first driver control signal in the multiple driver control signals based on the first driver control signal.

In specific implementation, the first delay unit can receive a first driver control signal XON1 output by the first control signal generating module 2101, delay the received first driver control signal XON1 a predetermined time to obtain a second driver control signal XON2, and output the second driver control signal XON2, and so on and so forth. The (n−2)-th delay unit can receive a (n−2)-th driver control signal. XON(n−2) output by a n−3)-th delay unit, delay the received (n−2)-th driver control signal XON(n−1) a predetermined time to obtain a (n−1)-th driver control signal XON(n−1), and output (n−1)-th driver control signal XON (n−1); the (n−1)-th delay unit can receive a (n−1)-th driver control signal XON(n−1) output by a (n−2)-th delay unit, delay the received (n−1)-th driver control signal XON(n−1) a predetermined time to obtain a n-th driver control signal XONn, and output n-th driver control signal XONn.

In the specific implementation, each delay unit can comprise a fourth resistor and a capacitor. More specifically, in the first delay unit, a first terminal of the fourth resistor is connected to an output terminal of the first control signal generating module, and a second terminal of the fourth resistor is connected to a first capacitor of the capacitor, a second terminal of the capacitor is connected to a fourth power supply voltage terminal VSS, and a connecting point of the second terminal of the fourth resistor and the first terminal of the capacitor is taken as the output terminal of the delay unit to output a second driver control signal. In each of remaining delay units other than the first delay unit, the first terminal of the fourth resistor is connected to an output terminal of a previous delay unit, the second terminal of the fourth resistor is connected to the first terminal of the capacitor, the second terminal of the capacitor is connected to the fourth power supply voltage terminal VSS, and the connecting point of the second terminal of the fourth resistor and the first terminal of the capacitor is taken as the output terminal of the delay unit to output a driver control signal delayed relative to a driver control signal output by the previous delay unit.

Alternatively, in another specific implementation, the first delay unit can receive the first driver control signal XON1 output by the first control signal generating module, delay the received first driver control signal XON1 a first time to obtain the second driver control signal XON2, and output the second driver control signal XON2. Likewise, the (n−2)-th delay unit can receive the first driver control signal XON1 output by the first control signal generating module, delay the received first driver control signal XON1 a (n−2)-th time to obtain the (n−1)-th driver control signal XON(n−1), and output the (n−1)-th driver control signal XON(n−1); the (n−1)-th delay unit can receive the first driver control signal XON1 output by the first control signal generating module, delay the received first driver control signal XON1 the (n−1)-th time to obtain the n-th driver control signal XONn, and output the n-th driver control signal XONn. The (n−1)-th time can be (n−1) times of the first time, the n-th time can be n times of the first time.

Figure 11:
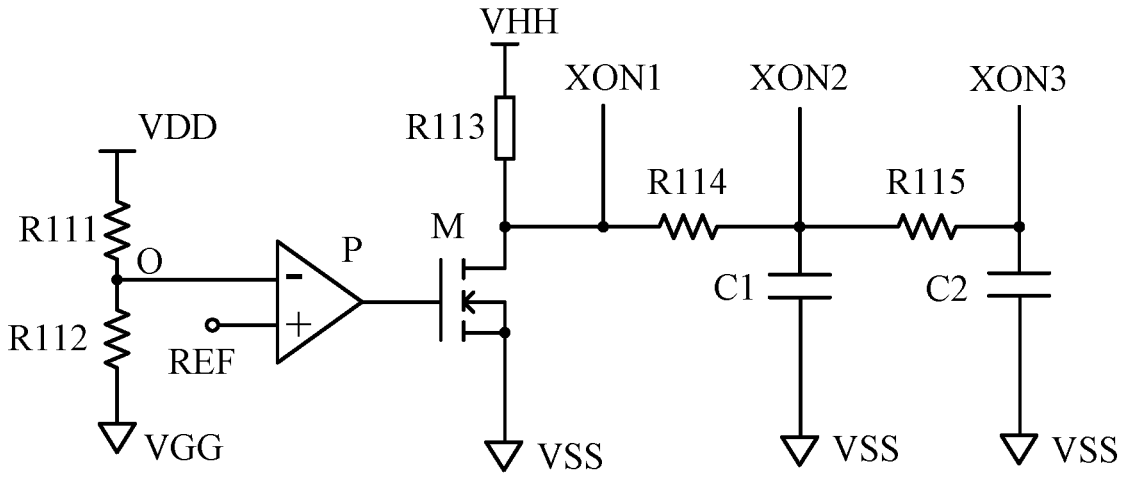
FIG. 11 shows a schematic circuit diagram of a driver control module according to a second embodiment of the present disclosure.

In FIG. 11, the schematic circuit diagram of the driver control module 210 is shown by taking the control voltage generating module as shown in FIG. 5A as an example and by taking the driver control module 210 comprising two delay units as an example.

The control voltage generating module of the first control signal generating module 2101 comprises a first resistor R111 and a second resistor R112, and the output module thereof comprises a comparator P, a switch transistor M, and a third resistor R113.

The first delay unit comprises a resistor R114 and a capacitor C1. A first terminal of the resistor R114 is connected to the output terminal of the first control signal generating module to receive the first driver control signal XON1 generated by the first control signal generating module, a second terminal of the resistor R114 is connected to a first terminal of the capacitor C11, a second terminal of the capacitor C1 is connected to the fourth power supply voltage terminal VSS, and a connecting point between the second terminal of the resistor R114 and the first terminal of the capacitor C1 is taken as an output terminal of the first delay unit to output the second driver control signal XON2.

The second delay unit comprises a resistor R115 and a capacitor C2. A first terminal of the resistor R115 is connected to the output terminal of the first delay unit to receive the second driver control signal XON2, a second terminal of the resistor R115 is connected to a first terminal of the capacitor C2, and a second terminal of the capacitor C2 is connected to the fourth power supply voltage terminal VSS, and a connecting point between the second terminal of the resistor R115 and the first terminal of the capacitor C2 is taken as an output terminal of the second delay unit to output the third driver control signal XON3.

In the process of start-up of the liquid crystal display, the first power supply voltage $V_{DD}$ of the first power supply voltage terminal VDD is applied to the resistors R111 and R112 of the first control signal generating module. When the voltage $V_O$ at point O rises to be higher than the reference voltage Vref of the reference voltage terminal REF, output of the comparator P jumps from high level to low level, the switch transistor M changes from turn-on into turn-off, and the first driver control signal XON1 changes from low level into high level; after the XON1 changes from low level into high level, the capacitor C1 is charged by a RC circuit constituted of the resistor R114 and the capacitor C1, and the second driver control signal XON2 reaches a high level after the first delay time; after the XON2 reaches the high level, the capacitor C2 is charged by a RC circuit constituted of the resistor R115 and the capacitor C2, and the third drive control signal XON3 reaches high level after the second delay time.

The first delay time is decided by a resistance value $R_{114}$ of the resistor R114 and a capacitance value $C_1$ of the capacitor C1, and the second delay time is decided by a resistance value $R_{115}$ of the resistor R115 and a capacitance value $C_2$ of the capacitor C2. Specifically, the first delay time $t_{XON2}=R_{114}*C_1$, and the second delay time $t_{XON3}=R_{115}*C_2$.

In other words, a start-up time of the second gate driver 222 lags the first delay time $t_{XON2}$ than a start-up time of the first gate driver 221, and a start-up time of the third gate driver 223 lags the second delay time $t_{XON3}$ than a start-up time of the second gate driver 222. The first delay time $t_{XON2}$ and the second delay time $t_{XON3}$ are greater than a duration of current impact generated when each gate driver simultaneously outputs gate drive signals of low level at the output terminal of the gate driver. The first delay time $t_{XON2}$ and the second delay time $t_{XON3}$ can be several microseconds to several milliseconds. Optionally, the first delay time $t_{XON2}$ is equal to the second delay time $t_{XON3}$.

In the process of shut-down of the liquid crystal display, the first power supply voltage $V_{DD}$ of the first power supply voltage terminal VDD is not applied to the resistors R111 and R112 of the first control signal generating module again. When the voltage $V_O$ at point O decreases to be lower than the reference voltage Vref of the reference voltage terminal REF, the output of the comparator P jumps from low level to high level, the switch transistor M changes from turn-off into turn-on, and the first driver control signal XON1 changes from high level into low level; after the XON1 changes from high level into low level, the capacitor C1 is discharged by the RC circuit constituted of the resistor R114 and the capacitor C1, and the second driver control signal XON2 changes into the low level after the third delay time; after the XON2 changes into the low level, the capacitor C2 is discharged by a RC circuit constituted of the resistor R115 and the capacitor C2, and the second drive control signal XON3 changes into the low level after the fourth delay time. The third delay time is decided by the resistance value $R_{114}$ of the resistor R114 and the capacitance value $C_1$ of the capacitor C1, and the fourth delay time is decided by the resistance value $R_{114}$ of the resistor R114, the resistance value $R_{115}$ of the resistor R115 and the capacitance value $C_2$ of the capacitor C2.

Therefore, the shut-down time of the second gate driver 222 lags the third delay time than the shut-down time of the first gate driver 221, the shut-down time of the third gate driver 223 lags the fourth delay time than the shut-down time of the second gate driver 222. The third delay time and the fourth delay time are greater than a duration of current impact generated when each gate driver simultaneously outputs gate drive signals of low level at the output terminal of the gate driver. The third delay time and the fourth delay time can be several microseconds to several milliseconds.

It shall be understood that in the case that the gate drive device comprises n gate drivers, the gate drive device can comprises (n−1) delay units. A j-th delay unit delays a j-th driver control signal to obtain a (j+1)-th driver control signal, and a j-th driver control signal is used to control a j-th gate driver, where j=1, . . . , n−1, and n is an integer greater than or equal to 2.

Figure 12:
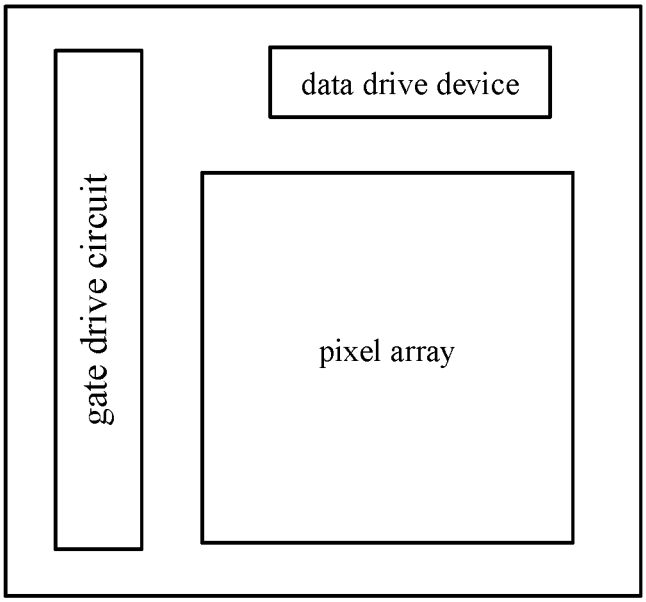
FIG. 12 shows a display panel according to an embodiment of the present disclosure.

FIG. 12 shows a display panel according to an embodiment of the present disclosure, comprising an array, a source drive device, and a gate drive device according to the embodiments of the present disclosure.

According to the embodiments of the present disclosure, since the duration of the impact current generated when each gate driver is stared up (shut down) is generally several microseconds, the start-up (shut-down) times of respective gate drivers can be staggered efficiently by controlling the first through eighth lagging times to be longer than the duration of the impact current, controlling the first time to be longer than the duration of the impact current, and controlling the first through fourth delay times to be longer than the duration of the impact current.

According to the embodiments of the present disclosure, by utilizing multiple driver control signals having a time delay between each other to control a plurality of gate drivers, the turn-on time of respective gate drivers can be staggered when it is started up, such that impact currents generated when the respective gate drivers are turned on are staggered from each other and not overlapped when it is started up, which reduces total impact currents (total impact currents of the power supply voltage terminal that provides the low voltage) when it is started up. On the other hand, by adopting the gate drive device according to the embodiments of the present disclosure, the turn-off time of respective gate drivers can be staggered when it is shut down, such that impact currents generated when the respective gate drivers are turned off are staggered from each other and not overlapped when it is shut down, which reduces total impact currents (total impact currents of the power supply voltage terminal that provides the high voltage) when it is shut down, which avoids the phenomenon that different gate drivers generate current impact at the same time and the current impacts generated by the respective gate drivers at the same time are overlapped to generate large current impact which results in damage of power supply chip, burn-out of power supply leads, and burn-out of fuse wires.

Respective embodiments of the present disclosure are described in detail above. However, those skilled in the art shall understand that various amendments, combination or sub-combination can be made to these embodiments without departing from the principle and spirit of the present disclosure, and these amendments shall fall into the scope of the present disclosure.

The present application claims the priority of a Chinese patent application No. 201510645169.7 filed on Oct. 8, 2015, with an invention title of "GATE DRIVE DEVICE OF PIXEL ARRAY AND DRIVE METHOD THEREOF". Herein, the content disclosed by the Chinese patent application is incorporated in full by reference as a part of the present disclosure.

What is claimed is:

1. A gate drive device of a pixel array which comprises N gate lines, comprising:

a plurality of gate drivers, wherein the N gate lines are divided into a plurality of groups, each of the plurality of groups comprises a plurality of gate lines, the plurality of gate drivers and the plurality of groups are in one-to-one correspondence, and each gate driver is configured to generate gate drive signals for a plurality of gate lines in a group corresponding thereto, where N is an integer greater than or equal to 4;

a driver control module, configured to generate multiple driver control signals corresponding one-to-one with the plurality of gate drivers, and state switching of any two driver control signals in the multiple driver control signals having a difference of at least a first time, wherein the plurality of gate drivers are configured to switch from a first state to a second state sequentially under control of the multiple driver control signals, and each gate driver generates gate drive signals with an identical phase for the plurality of gate lines in the group corresponding to the gate driver in the second state, wherein the driver control module comprises: a first control signal generating module, and a plurality of delay units;

the first control signal generating module is configured to generate a first driver control signal, and comprises a control voltage generating module configured to generate a control voltage; and an output module, whose first input terminal receives the control voltage generated by the control voltage generating module, second input terminal receives a reference voltage, and output terminal is taken as an output terminal of the first control signal generating module, and configured to generate the first driver control signal based on the control voltage and the reference voltage, the first driver control signal is the first level when the control voltage and the reference voltage satisfy the first relationship, while the first driver control signal is the second level when the control voltage and the reference voltage do not satisfy the first relationship; and the plurality of delay units are configured to generate other driver control signals except for the first driver control signal in the multiple driver control signals, wherein each delay unit comprises: a fourth resistor and a capacitor, in a first delay unit, a first terminal of the fourth resistor is connected to the output terminal of the first control signal generating module, a second terminal of the fourth resistor is connected to a first terminal of the capacitor, a second terminal of the capacitor is connected to the fourth power supply voltage terminal, and a connection point of the second terminal of the fourth resistor and the first terminal of the capacitor is taken as an output terminal of the delay unit to output a second driver control signal; and in each of remaining delay units other than the first delay unit, the first terminal of the fourth resistor is connected to an output terminal of a previous delay unit, the second terminal of the fourth resistor is connected to the first terminal of the capacitor, the second terminal of the capacitor is connected to the fourth power supply voltage terminal, and the connection point of the second terminal of the fourth resistor and the first terminal of the capacitor is taken as the output terminal of the delay unit to output a driving control signal delayed relative to a driving control signal output by its previous delay unit.

2. The gate drive device according to claim 1, wherein the first state is a normal operation state, and the second state is a shut-down transient state, wherein in the first state, at any moment, only one gate drive signal of a plurality of gate drive signals generated by one gate driver of the plurality of gate drivers for the plurality of gate lines in a group corresponding to the gate driver is in a valid drive level while remaining gate drive signals are in an invalid drive level, and gate drive signals generated by remaining gate drivers in the plurality of gate drivers are in an invalid drive level; and each of the gate driver is configured to simultaneously generate gate drive signals being in a valid drive level for a plurality of gate lines in the group corresponding thereto when the gate driver switches from the first state to the second state.

3. The gate drive device according to claim 1, wherein the first state is a shut-down state, the second state is a start-up transient state, wherein each gate driver is configured to not output a gate drive signal in the first state; and each gate driver of the gate drivers is configured to simultaneously generate gate drive signals being in an invalid drive level for the plurality of gate lines in the group corresponding thereto in the case that the gate driver switches from the first state to the second state.

4. The gate drive device according to claim 1, wherein state switching of the driver control signal comprises at least one of the followings: the driver control signal switches from high level to low level, the driver control signal switches from low level to high level, and the first time can be a duration of a current impact generated for each gate driver.

5. A drive method for the gate drive device according to claim 1, comprising:

generating, by the driver control module, a plurality of driver control signals sequentially, the plurality of driver control signals and the plurality of gate drivers being in one-to-one correspondence, and state switching of any two of the multiple driver control signals having a difference of at least a first time; and switching, by the plurality of gate drivers, from a first state to a second state sequentially under control of the multiple driver control signals respectively, and generating, by each gate driver, gate drive signals with an identical phase for a plurality of gate lines in the group corresponding to the gate driver in a second state.

6. The drive method according to claim 5, wherein the first state is a normal operation state, and the second state is a shut-down transient state, wherein in the first state, at any moment, only one gate drive signal of the plurality of gate drive signals generated by one gate driver of the plurality of gate drivers for the plurality of gate lines in a group corresponding thereto is in a valid drive level while remaining gate drive signals are in an invalid drive level, and gate drive signals generated by the remaining gate drivers in the plurality of gate drivers are all in an invalid drive level; and when one of the gate drivers switches from the first state to the second state, the gate driver simultaneously generates gate drive signals being in a valid drive level for the plurality of gate lines in the group corresponding thereto.

7. The drive method according to claim 5, wherein the first state is a shut-down state, the second state is a start-up transient state, wherein each of the gate drivers does not output a gate drive signal in the first state;

one of the gate drivers simultaneously generates gate drive signals being in an invalid drive level for the plurality of gate lines in the group corresponding thereto when the gate driver switches from the first state to the second state.

8. The drive method according to claim 5, wherein the driver control module comprises: the first control signal generating module, and the plurality of delay units;

the first control signal generating module is configured to generate the first driver control signal, and comprises:

the control voltage generating module configured to generate the control voltage; and the output module, whose first input terminal receives the control voltage generated by the control voltage generating module, second input terminal receives the reference voltage, and output terminal is taken as the output terminal of the first control signal generating module, and configured to generate the first driver control signal based on the control voltage and the reference voltage, the first driver control signal being the first level when the control voltage and the reference voltage satisfy the first relationship, while the first driver control signal being the second level when the control voltage and the reference voltage do not satisfy the first relationship; and the plurality of delay units are configured to generate driver control signals other than the first driver control signal in the multiple driver control signals.

9. The drive method according to claim 8, wherein generating multiple driver control signals sequentially by the driver control module comprises:

generating a first driver control signal; and delaying a j-th driver control signal at least a first time to obtain a (j+1)-th driver control signal, where $j=1, \ldots, n-1$, n is a number of gate drivers in the gate drive device, and n is an integer greater than or equal to 2.

10. A display panel, comprising a pixel array, a source drive device, and a gate drive device according to claim 1.

* * * * *